US005673466A

United States Patent [19]

Fleissner

[11] Patent Number: 5,673,466

[45] Date of Patent: Oct. 7, 1997

[54] DEVICE FOR CRIMPING SYNTHETIC WRAPS AND THE LIKE

[75] Inventor: Gerold Fleissner, Zug, Switzerland

[73] Assignee: Fleissner GmbH & Co., Maschinenfabrik, Egelsbach, Germany

[21] Appl. No.: 617,109

[22] Filed: Mar. 18, 1996

[30] Foreign Application Priority Data

Mar. 16, 1995 [DE] Germany ..... 195 09 095.0

[51] Int. Cl.[6] ..... D02G 1/12

[52] U.S. Cl. ..... 28/269; 28/263

[58] Field of Search ..... 28/221, 247, 262, 28/263, 264, 268, 269

[56] References Cited

U.S. PATENT DOCUMENTS

| | | | |
|---|---|---|---|
| 3,237,270 | 3/1966 | Dennis . | |
| 3,305,897 | 2/1967 | Meibohm | 28/269 |
| 3,600,776 | 8/1971 | Aoki et al. | 28/269 |
| 3,618,183 | 11/1971 | Funk et al. | 28/269 |
| 3,800,373 | 4/1974 | Fleissner . | |
| 4,589,173 | 5/1986 | Fleissner | 28/269 |
| 4,662,042 | 5/1987 | Bayliss, Sr. | 28/269 |
| 4,730,371 | 3/1988 | Broaddus | 28/269 |
| 5,105,513 | 4/1992 | Marx et al. . | |

FOREIGN PATENT DOCUMENTS 26 04 505 8/1976 Germany .

*Primary Examiner*—C. D. Crowder
*Assistant Examiner*—Larry D. Worrell, Jr.
*Attorney, Agent, or Firm*—Antonelli, Terry, Stout & Kraus, LLP.

[57] ABSTRACT

A stuffer box crimping unit provided with a crimping chamber and two feed rolls associated with the chamber and located upstream thereof, has pressure disks associated on both sides in side walls of the crimping chamber at the level of the nip between the two feed rolls. These two disks are not only made from a material provided for wear, but also from a separate carrier disk made of appropriate material. The carrier disk is a wear element shaped like a lid and made of the nonferrous metal intended for wear in the direction facing the pressure roll nip. This wear element is readily replaced and there is no need any longer for regrinding the wear surfaces of pressure disks so that the disks can be reused.

17 Claims, 1 Drawing Sheet

DEVICE FOR CRIMPING SYNTHETIC WRAPS AND THE LIKE

FIELD OF THE INVENTION

This invention relates to a device for crimping synthetic warps, filament bundles, or filament ribbons with a pair of pressure rolls and a stuffer box located downstream from the rolls, the box comprising two plates aligned parallel to the axis of the rolls, with one of the plates pivotable at least partially against the other to reduce the size of a crimping chamber defined by the box, and the box also having two side walls limiting the chamber in the box up to the nip of the pressure rolls (or pressure roll nip), in which side walls, at the level of the nip, a pressure disk is provided, the disk being associated with marginal areas of the roll ends and urged by an adjusting unit, for example with pressure, against the roll ends, the disk generally being formed, e.g. cut, into a cylindrical shape.

BACKGROUND OF THE INVENTION

A device of the type heretofore noted is known, for example, from DE 21 17 393 A1. The marginal area between the pressure roll nip of the pair of pressure rolls and the pressure disks intended for wear is one of the most difficult to control in the entire stuffer box crimping unit. The purpose of the design is to ensure that the fibers fed into the stuffer box by the pair of pressure rolls at high pressure are not squeezed laterally out of the device. At the same time the wear that must necessarily occur between the rotating roll ends and the fixed pressure disks should be reduced to a minimum, but in particular it should be uniform at the surface of the pressure disks. To achieve this, it is known from the above-mentioned Offenlegungsschrift to mount the pressure disks rotatably and to rotate the disks in steps or continuously. In this manner, the abrasion on the ends of the pressure disks occurs at least uniformly over the contact surfaces.

Depending on the set pressure against the back of the pressure disks, the disks must be frequently replaced nevertheless, after approximately 4–6 hours of operation. The disk must then be replaced by a new one and the used one must be freed in a grinding shop, for example, from the operation (working or wear) marks. This replacement and grinding process can be performed several times but the disk will be worn out after ten such grinding processes and must then be discarded together with its rear drive holes and the threaded holes required for replacement on the circumferential surface of the pressure disk. Apart from the fact that this represents a high material cost, the investment in the grinding equipment and the labor, etc., required for replacement must also be considered.

SUMMARY OF THE INVENTION

The goal of the invention is to develop a pressure disk with which the cost of regrinding, and thus the acquisition of a grinder and the necessary operators, can be eliminated.

Takings its departure from a device of the type heretofore described, provision is made to achieve the stated goal such that the pressure disk is composed of a carrier disk and a wear element fastened thereto.

The idea of the invention appears to be astonishingly simple, but it has far-reaching consequences. The carrier disk can be made of any desired and appropriate material and reused over and over again. The precision work on the carrier disk with the individual holes and threads is required only once. The wear area on the pressure disk is thus defined by a separate wear element that can be replaced at any time and can be manufactured out of softer and less expensive nonferrous metal. The wear element can be stamped as a disk from a suitable piece of sheet metal, for example, so that it has the diameter of the carrier disk, and provided with a collar bent in the shape of the letter U along the diameter for easy nonrotatable connection with the carrier disk, the collar then partially engaging the carrier disk.

Advantageously, the carrier disk can also be made of a porous material, for example, a sintered ceramic or metallic material which, as provided in DE 33 26 589 A1 and corresponding U.S. Pat. No. 4,589,173, can be cooled at the back by a fluid. A porous material could not be used previously for the pressure disk because the grinding that was formerly necessary would always clog the pores of the wear surface with grinding dust.

BRIEF DESCRIPTION OF THE DRAWINGS

The accompanying drawings show an embodiment according to the invention wherein.

DETAILED DESCRIPTION OF THE INVENTION

Figure 1:
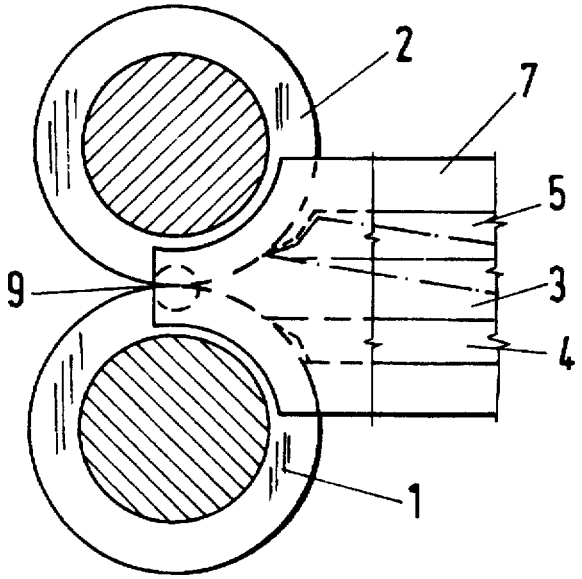
FIG. 1 is a side view of a stuffer box crimping unit in the vicinity of the pair of pressure rolls.
Figure 2:
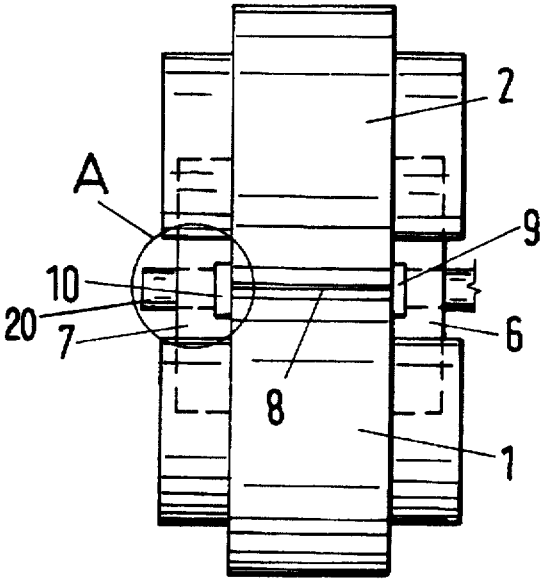
FIG. 2 shows the stuffer box crimping unit in an end view looking in the direction of the incoming textile material.

The device for crimping synthetic warps essentially consists of pressure rolls 1 and 2 that serve a pair of guide and pressure rolls and of a stuffer box 3 located downstream, which is delimited by the two plates 4, 5 aligned coaxially with rolls 1, 2, with plate 5 being mounted pivotably with respect to plate 4 to reduce the size of box 3, and by the two lateral walls 6, 7 extending up to pressure roll nip 8. Lateral walls 6, 7 are rigidly fastened to lower plate 4.

Pressure disks 9, 10 are mounted freely rotatably in lateral walls 6, 7 at the level of pressure roll nip 8 and urged by pressure of the adjustment unit 20 in the direction of the arrow. The drive for turning the pressure disks around their horizontal axis is not shown for the sake of simplicity. In general, this is accomplished by means of holes in the back of pressure disks 9, 10 with pins of the drive engaging the holes.

Figure 3A:
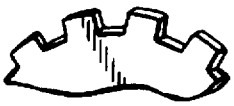
FIG. 3*a* is a partial perspective view of another embodiment of the wear element.
Figure 3:
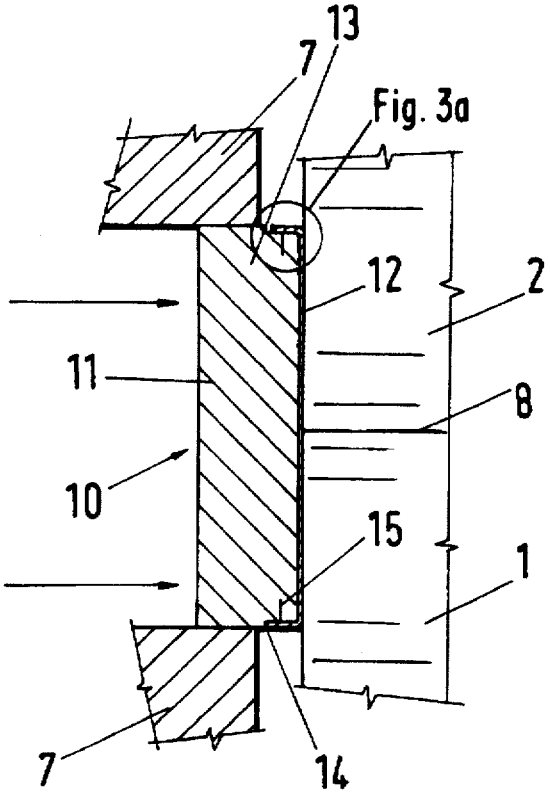
FIG. 3 is a section through the pair of pressure rolls at the level of the pressure roll nip according to detail A, with the pressure disk abutting endwise.

Pressure disks 9, 10 according to FIG. 3 do not consist of a single body but of a carrier disk 11 and a wear element 12. Wear element 12, as shown in FIG. 3, fits like a lid on the wear side of the carrier disk. Wear element 12 is made exclusively of nonferrous metal used for parts subject to wear. In simple fashion, it is stamped out of a sheet of such material and then provided with a collar 13 all the way around its periphery to form a lid. This lid fits positively around carrier disk 11 provided with a corresponding groove 14 on its circumference and is intended to be connected nonrotatably by means of this collar 13 with carrier disk 11. For example, a fixed dog or pin 15 in carrier disk 11 could serve, for example, to lock into gaps stamped in collar 13 of the wear lid. Other fastening methods are possible. For example, FIG. 3*a* shows a portion of a wear element 12' having a sawtooth edge. The teeth fit into matching grooves on the outer circumference of the end face of the carrier disk so that the wear element 12' is mounted nonrotatably on the carrier disk.

Because of this design of the pressure disk, only the material of the wear element 12 is selected for its wear characteristics. The carrier disk material can be made especially inexpensively or even from sintered material, which is porous and therefor better suited for cooling the pressure disk with a liquid.

The carrier disk is generally made of VA steel, i.e. VA 1.4057 according to the German standard; whereas the wear element is made of a nonferrous metal, i.e. a copper-brass alloy, CuZn25A15, a special bronze.

What is claimed is:

1. A device for crimping synthetic warps, filament bundles, or filament ribbons comprising a pair of pressure rolls forming a nip therebetween, and a stuffer box located downstream therefrom, said box comprising two plates aligned parallel to axes of the pressure rolls, at least one of which plates is pivotable at least partially against the other plate to reduce size of a crimping chamber defined by the stuffer box, and two side walls that delimit the size of the box up to the nip of the pair of pressure rolls, a pressure disk being provided in each of the side walls at the level of the nip, each pressure disk being arranged adjacent to marginal areas of the associated roll ends and applying pressure against the roll ends, said pressure disks each being formed to have a generally cylindrical configuration, each pressure disk comprising a carrier disk and a wear element fastened thereto; said wear element contacting the roll ends.

2. A device according to claim 1, wherein the wear element is likewise made in the form of a disk.

3. A device according to claim 1, wherein the carrier disk has an edge and the wear element is shaped like a lid that covers at least a part of the edge of the carrier disk.

4. A device according to claim 2, wherein the carrier disk has an edge and the wear element is shaped like a lid that covers at least a part of the edge of the carrier disk.

5. A device according to claim 2, wherein the wear element has at least the same diameter as that of the carrier disk.

6. A device according to claim 2, wherein the wear element has a planar wear wall and a flange edge extending at least partially around the wear wall.

7. A device according to claim 6, wherein the wear element is nonrotatably connected with the carrier disk in the vicinity of the flange edge.

8. A device for crimping synthetic warps, filament bundles, or filament ribbons comprising a pair of pressure rolls forming a nip therebetween, and a stuffer box located downstream therefrom, said box comprising two plates aligned parallel to axes of the pressure rolls, at least one of which plates is pivotable at least partially against the other plate to reduce size of a crimping chamber defined by the stuffer box, and two side walls that delimit the size of the box up to the nip of the pair of pressure rolls, a pressure disk being provided in each of the side walls at the level of the nip, each pressure disk being arranged adjacent to marginal areas of the associated roll ends and applying pressure against the roll ends, said pressure disks each being formed to have a generally cylindrical configuration, each pressure disk comprising a carrier disk and a wear element fastened thereto; said wear element contacting the roll ends and being mounted releasably on the carrier disk and held nonrotatably by dogs to the carrier disk.

9. A device according to claim 8, wherein the wear element has a planar wear wall and a flange edge extending at least partially around the wear wall, the flange edge being used to provide a nonrotatable connection with the carrier disk.

10. A device according to claim 9, wherein the flange disk has recesses and, to produce the nonrotatable connection, the carrier disk has fixed dogs on its radial circumference, said dogs engaging the recesses in the flange edge of the wear element or vice versa.

11. A device according to claim 10, wherein the carrier disk has a groove all the way around its periphery in the vicinity of the flange edge of wear element when mounted.

12. A device according to claim 11, wherein the wear element is stamped from a sheet of a wear metal.

13. A device according to claim 12, wherein a cylindrical marginal area of the wear element is bent after stamping.

14. A device according to claim 13, wherein the carrier disk is made from a hard and porous material.

15. A device according to claim 14, wherein the carrier disk is made from a sintered material.

16. A device according to claim 15, wherein the carrier disk is porous and is cooled over its surface by a fluid.

17. A device according to claim 7, wherein the wear element is provided with a sawtooth edge with teeth which fit into matching grooves in the carrier disk.

* * * * *